US011450991B2

(12) United States Patent
Wei et al.

(10) Patent No.: US 11,450,991 B2
(45) Date of Patent: Sep. 20, 2022

(54) CONNECTOR HOUSING

(71) Applicants: Tyco Electronics (Zhuhai) Ltd, Zhuhai (CN); Tyco Electronics (Shanghai) Co., Ltd., Shanghai (CN)

(72) Inventors: Jikang Wei, Zhuhai (CN); Huiliang Luo, Zhuhai (CN); Shufeng Jia, Zhuhai (CN); Qiang Yu, Zhuhai (CN); Hongwen Yang, Shanghai (CN); Hongqiang Han, Shanghai (CN); Jiahui Chen, Shanghai (CN)

(73) Assignees: Tyco Electronics (Shanghai) Co. Ltd., Shangahai (CN); Tyco Electronics (Zhuhai) Ltd., Zhuhai (CN)

( * ) Notice: Subject to any disclaimer, the term of this patent is extended or adjusted under 35 U.S.C. 154(b) by 0 days.

(21) Appl. No.: 17/109,284

(22) Filed: Dec. 2, 2020

(65) Prior Publication Data

US 2021/0175667 A1 Jun. 10, 2021

(30) Foreign Application Priority Data

Dec. 5, 2019 (CN) ..... 201911238282.8

(51) Int. Cl.
*H01R 13/6581* (2011.01)

(52) U.S. Cl.
CPC ..... *H01R 13/6581* (2013.01)

(58) Field of Classification Search
CPC ..... H01R 13/6581
USPC ..... 439/607.2
See application file for complete search history.

(56) References Cited

U.S. PATENT DOCUMENTS

| | | | | |
|---|---|---|---|---|
| 4,673,321 | A * | 6/1987 | Herb | F16B 13/122 411/40 |
| 6,508,670 | B1 * | 1/2003 | Hwang | H01R 13/6594 439/607.37 |
| 7,789,706 | B2 * | 9/2010 | Chen | H01R 12/712 439/607.35 |
| 9,653,850 | B1 * | 5/2017 | Su | H01R 24/60 |
| 9,872,419 | B1 * | 1/2018 | Arekar | H05K 5/04 |
| 10,601,181 | B2 * | 3/2020 | Lu | H01R 13/6272 |
| 2019/0173232 | A1 * | 6/2019 | Lu | H01R 13/6271 |

* cited by examiner

*Primary Examiner* — Peter G Leigh
(74) *Attorney, Agent, or Firm* — Barley Snyder

(57) ABSTRACT

A connector housing includes an accommodation space defined by four walls and formed with an insertion port. The four walls include a first wall extending in a first plane and a second wall extending in a second plane perpendicular to the first plane, the first wall is connected with the second wall at a corner of the connector housing. A first positioning groove is disposed in an edge of the first wall proximate to the insertion port and a first positioning tooth is disposed on an edge of the second wall. The first positioning tooth extends in the first plane by vertically bending and engaging within the first positioning groove. The first positioning tooth and the first positioning groove have a first locking feature preventing the first positioning tooth from being disengaged from the first positioning groove in a direction perpendicular to the second plane.

20 Claims, 8 Drawing Sheets

CONNECTOR HOUSING

CROSS-REFERENCE TO RELATED APPLICATION

This application claims the benefit of the filing date under 35 U.S.C. § 119(a)-(d) of Chinese Patent Application No. 201911238282.8, filed on Dec. 9, 2019.

FIELD OF THE INVENTION

The present invention relates to a housing and, more particularly, to a housing for an electrical connector.

BACKGROUND

A transmission rate of a connector used in a communication system, such as an optical module connector, is getting higher and higher. For such a high-speed connector, in order to ensure that a transmission signal is free from external electromagnetic interference, it is necessary to equip the high-speed connector with a connector housing (connector cage). Generally, such connector housing is made from thin metal plate pieces.

The connector housing has a generally cuboid shape and at least two adjacent side walls, such as a bottom wall and a side wall, thereof are connected with each other at a corner of the connector housing. The connector housing is formed with a port suitable for an insertion of an electronic device such as an optical module at an end of the connector housing. A plurality of electromagnetic shielding sheets are circumferentially mounted on an outer edge of the connector housing proximate to the port.

Due to the influence of the electromagnetic shielding sheet, the bottom wall and the side wall proximate to the electromagnetic shielding sheet are just stacked together without a sufficient holding force to resist an external force. Therefore, when the optical module is inserted into the connector housing through the port, the bottom wall and/or the side wall would be expanded outwardly and warped, which will result in a gap at the corner proximate to the port. Such gap may cause serious electromagnetic leakage, and adversely affect the electromagnetic shielding performance of the connector housing.

SUMMARY

A connector housing includes an accommodation space defined by four walls and formed with an insertion port. The four walls include a first wall extending in a first plane and a second wall extending in a second plane perpendicular to the first plane, the first wall is connected with the second wall at a corner of the connector housing. A first positioning groove is disposed in an edge of the first wall proximate to the insertion port and a first positioning tooth is disposed on an edge of the second wall. The first positioning tooth extends in the first plane by vertically bending and engaging within the first positioning groove. The first positioning tooth and the first positioning groove have a first locking feature preventing the first positioning tooth from being disengaged from the first positioning groove in a direction perpendicular to the second plane.

BRIEF DESCRIPTION OF THE DRAWINGS

The invention will now be described by way of example with reference to the accompanying Figures, of which.

DETAILED DESCRIPTION OF THE EMBODIMENTS

Figure 1:
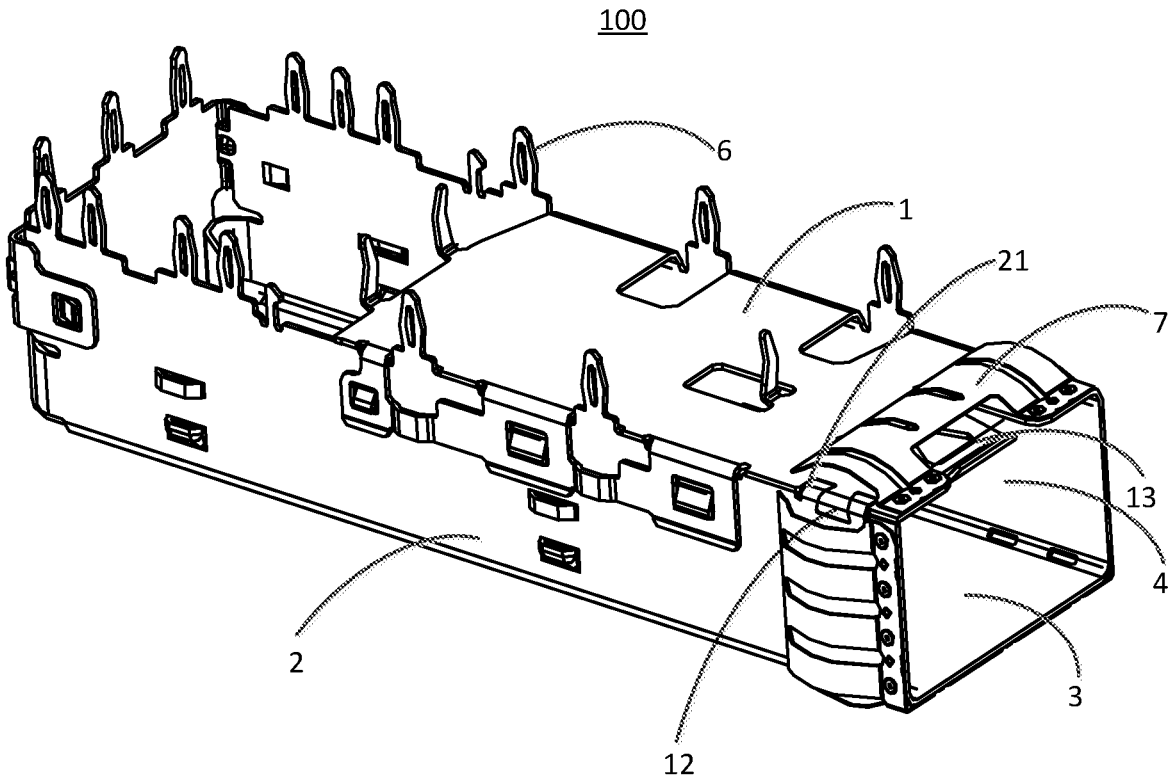
FIG. 1 is a perspective view of a connector housing according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
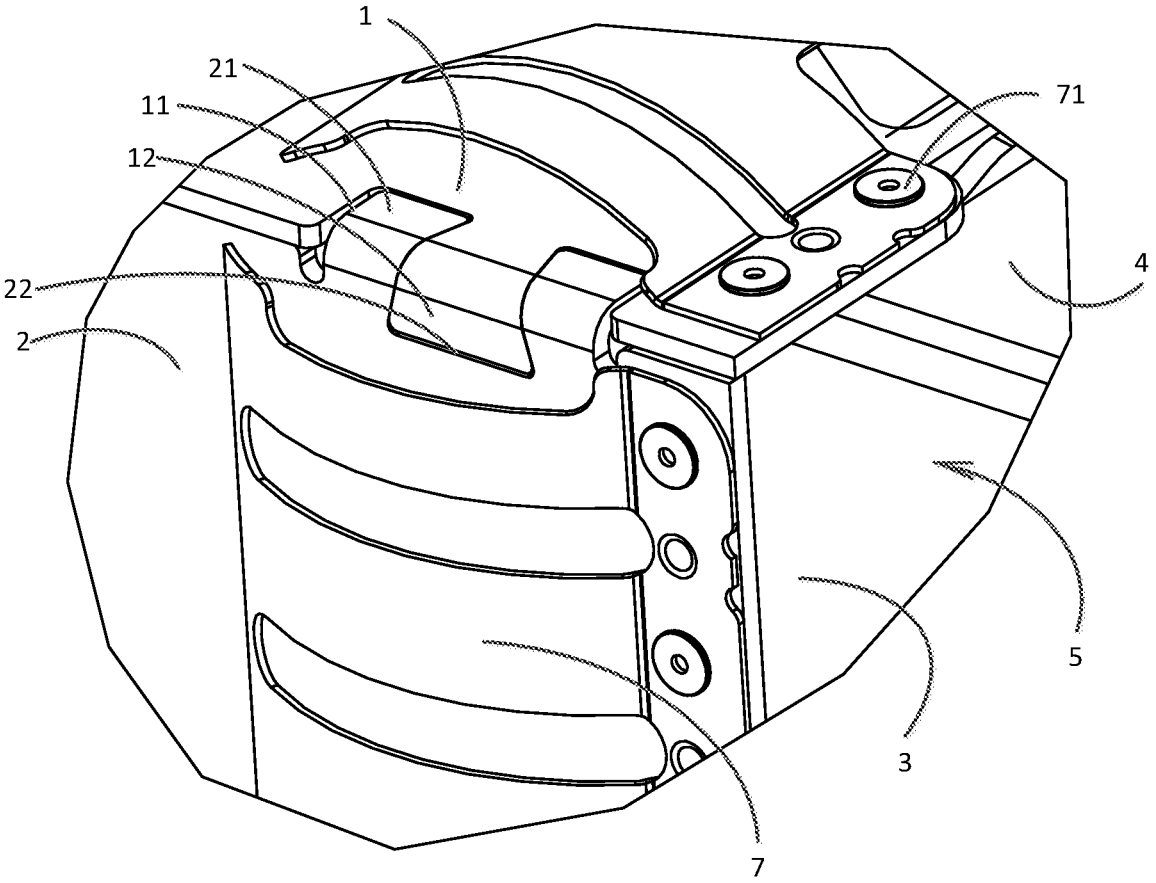
FIG. 2 is a detail perspective view of a portion of the connector housing of FIG. 1.

As shown in FIGS. 1 and 2, according to an exemplary embodiment of the disclosure, a connector housing 100 comprises an accommodation space defined by four walls 1, 2, 3, 4 and formed with an insertion port 5. The insertion port 5 is suitable for an insertion of an optical module connector or an electrical connector. The four walls include a first wall 1, such as a bottom wall, extending in a first plane (for example, a horizontal plane), and a second wall 2, such as a side wall, extending in a second plane (for example, a vertical plane) perpendicular to the first plane. The first wall 1 and the second wall 2 are connected with each other at a corner of the connector housing. It is appreciated that the first wall 1 and the second wall 2 may be any two adjacent walls connected with each other at the corner.

A retaining elastic sheet 13 for elastically pressing the inserted optical module connector or the electrical connector is provided on an edge of the first wall 1 proximate to the insertion port 5, as shown in FIG. 1.

The four walls, as shown in FIG. 1, include a fourth wall 4, such as another side wall, opposite to the second wall 2. Each of the two side walls 2, 4 is provided with pins 6 for fixing the connector housing 100 to a circuit board.

As shown in FIGS. 1 to 5, at least one first positioning groove 11 is provided in the edge of the first wall 1, such as the bottom wall, proximate to the insertion port 5, and at least one first positioning tooth 21 is provided on an edge of the second wall 2. The first positioning tooth 21 extends in the first plane by vertically bending and is engaged within the first positioning groove 11. The first positioning tooth 21 and the first positioning groove 11 have a first locking feature adapted to prevent the first positioning tooth 21 from being disengaged from the first positioning groove 11 in a direction perpendicular to the second plane. In this way, it is possible to prevent the second wall 2 from being disengaged from the first positioning groove 11 in the direction perpendicular to the second plane through an engagement of the first positioning tooth 21 and the first positioning groove 11. That is, the second wall 2 is prevented from being moving in a lateral direction, in particular, the second wall 2 is prevented from moving outwardly in the lateral direction.

In an exemplary embodiment of the disclosure, as shown in FIGS. 1 to 3, 6 and 7, at least one second positioning groove 22 is provided in the edge of the second wall 2, such as the side wall, proximate to the insertion port 5, and at least one second positioning tooth 12 is provided on the edge of the first wall 1. The second positioning tooth 12 extends in the second plane by vertically bending and is engaged with the second positioning groove 22. The second positioning tooth 12 and the second positioning groove 22 have a second locking feature adapted to prevent the second positioning tooth 12 from being disengaged from the second positioning groove 22 in a direction perpendicular to the first plane. In this way, it is possible to prevent the first wall 1 from being disengaged from the second positioning groove 22 in the direction perpendicular to the first plane through an engagement of the second positioning tooth 12 and the second positioning groove 22. That is, the first wall 1 is prevented from being moving in a height direction, in particular, the first wall 1 is prevented from moving outwardly in the height direction.

The first locking feature is adapted to prevent the second wall 2 from moving outwardly in the lateral direction and the second locking feature is adapted to prevent the first wall 2 from moving outwardly in the height direction, so that the first wall 1 and the second wall 2 are closely and firmly connected with each other at the corner. It is possible to avoid a gap from being generated at the corner when the connector housing 100 is applied with an external force, for example, when the connector housing 100 is squeezed during an insertion of the electronic module or the optical module into the insertion port 5.

In an exemplary embodiment of the disclosure, as shown in FIGS. 1 to 5, the first locking feature has a first protrusion 211 and a first recess 111. The first protrusion 211 is formed on the first positioning tooth 21 and protrudes in a length direction of the connector housing 100 (the left-and-right direction in FIG. 5). The first recess 111 is formed in the first positioning groove 11 and is configured to receive the first protrusion 211. Since the length direction is perpendicular to the lateral direction, the second wall 2 may be prevented from moving outwardly in the lateral direction.

Figure 4:
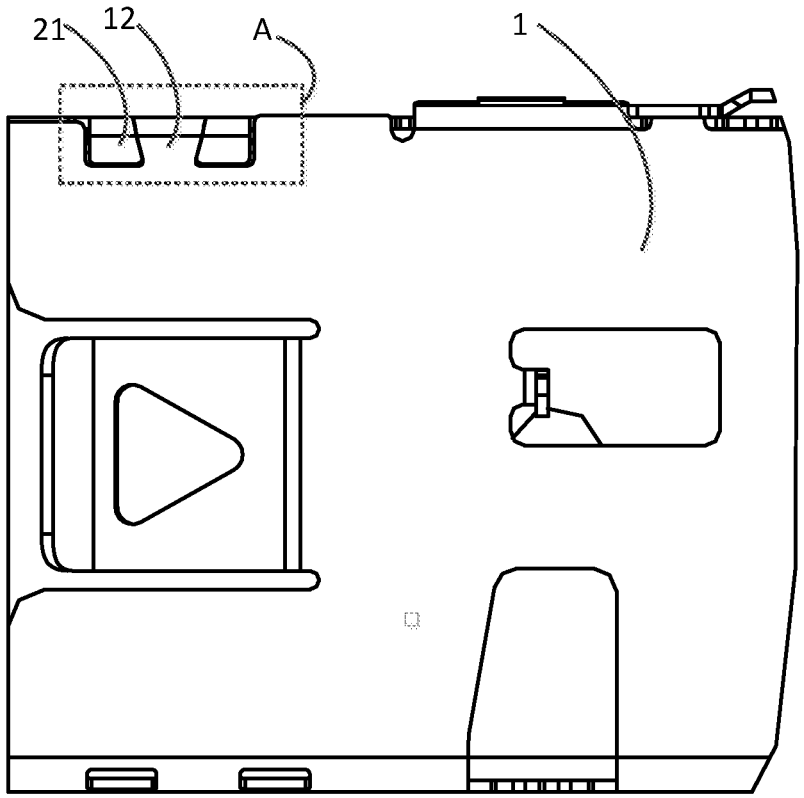
FIG. 4 is a detail top view of a portion of the connector housing of FIG. 1 with an electromagnetic shielding elastic sheet removed.
Figure 5:
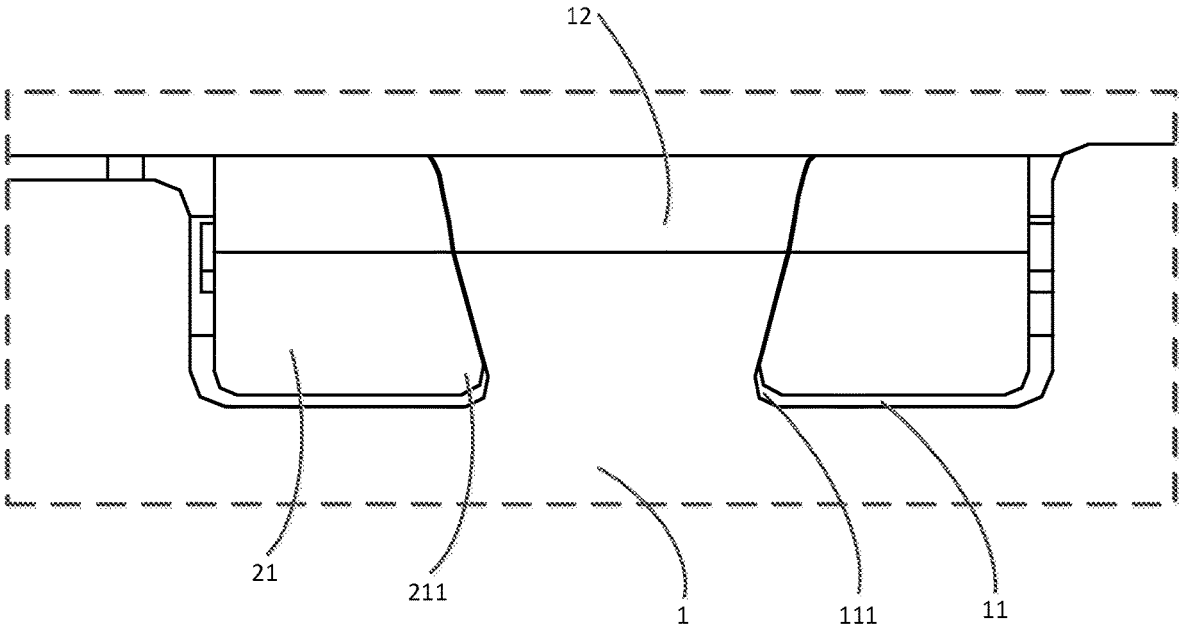
FIG. 5 is a schematic enlarged view of a part A in FIG. 4.

In an exemplary embodiment of the disclosure, as shown in FIGS. 2, 4, and 5, the first positioning groove 11 is formed as a wedge-shaped groove (or a trapezoidal groove), and the first positioning tooth 21 is formed as a wedge-shaped tooth (or a trapezoidal tooth). In this way, the adjacent first wall 1 and the second wall 2 may be closely and firmly connected to each other by the wedge-shaped tooth and the wedge-shaped groove.

Figure 6:
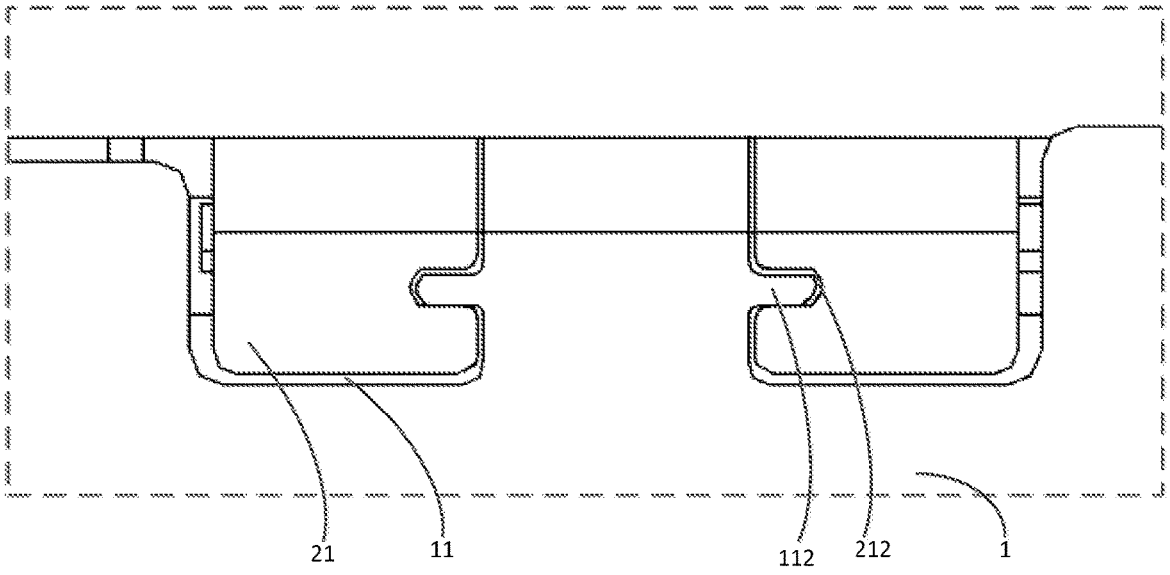
FIG. 6 is a schematic enlarged view of the part A according to another embodiment.

Referring to FIG. 6, in an alternative embodiment of the disclosure, the first locking feature may comprise a first protrusion 112 and a first recess 212. The first protrusion 112 is formed on the first positioning groove 11 and protrudes in the length direction of the connector housing 100 (the left-and-right direction in FIG. 8). The first recess 212 is formed in the first positioning tooth 21 and is configured to receive the first protrusion 112. Since the length direction is perpendicular to the lateral direction, the second wall 2 may be prevented from moving outwardly in the lateral direction.

Figure 7:
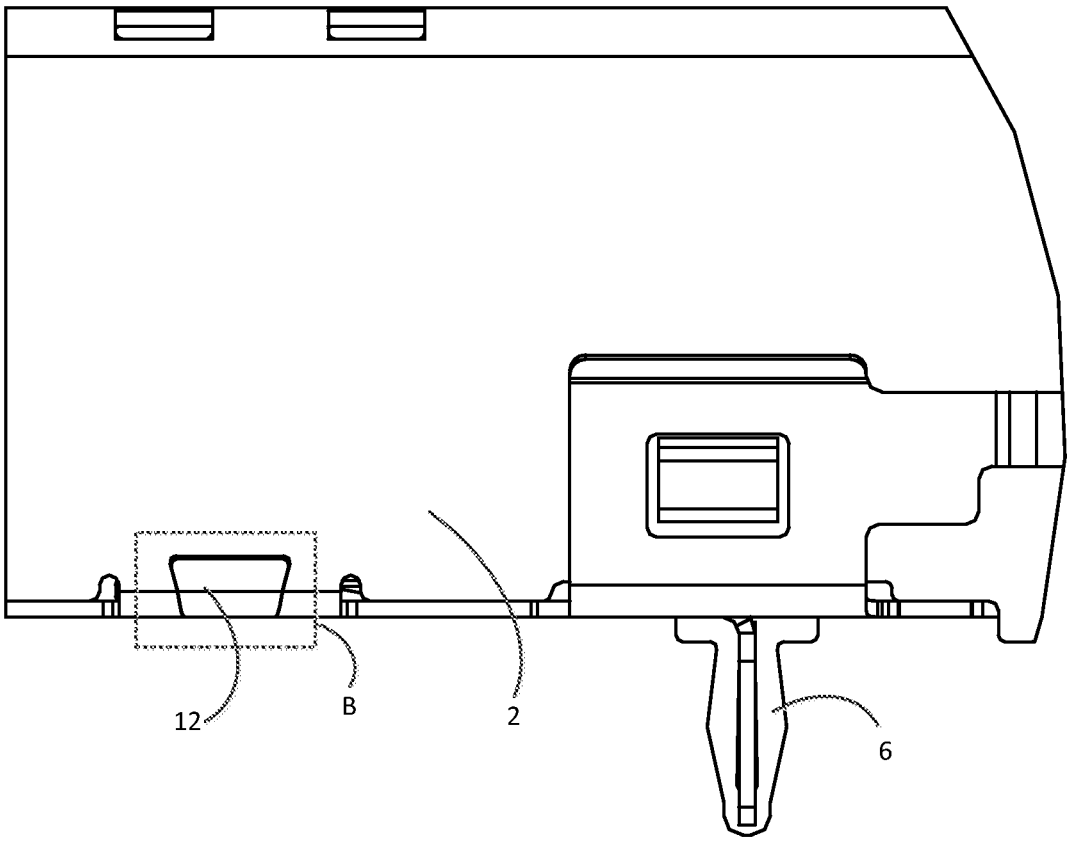
FIG. 7 is a detail side view of a portion of the connector housing of FIG. 1.
Figure 8:
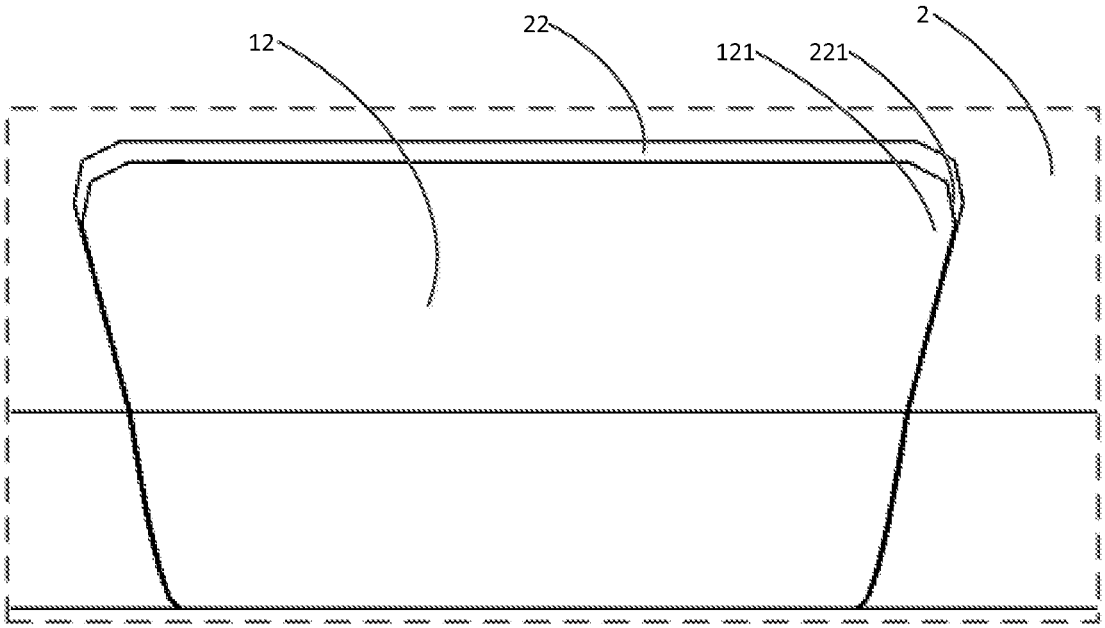
FIG. 8 is a schematic enlarged view of a part B in FIG. 7.

In an exemplary embodiment of the disclosure, as shown in FIGS. 2, 7 and 8, the second locking feature comprises a second protrusion 121 and a second recess 221. The second protrusion 121 is formed on the second positioning tooth 12 and protrudes in the length direction of the connector housing 100. The second recess 221 is formed in the second positioning groove 22 and is configured to receive the second protrusion 121. Since the length direction is perpendicular to the height direction, the second wall 2 may be prevented from moving outwardly (downwardly) in the height direction.

In an exemplary embodiment of the disclosure, as shown in FIGS. 2, 7 and 8, the second positioning groove 22 is formed as a wedge-shaped groove (or a trapezoidal groove), and the second positioning tooth 12 is formed as a wedge-shaped tooth (or a trapezoidal tooth). In this way, the adjacent first wall 1 and the second wall 2 may be closely and firmly connected with each other by the wedge-shaped tooth and the wedge-shaped groove.

In an embodiment, a minimum distance between any one of the first positioning groove 11, the first positioning tooth 21, the second positioning groove 22 and the second positioning tooth 12, and the edge of the insertion port 5 is not more than 2 mm. In this way, it is possible to increase the engagement force of the first wall 1 and the second wall 2 proximate to the insertion port 5.

Figure 10:
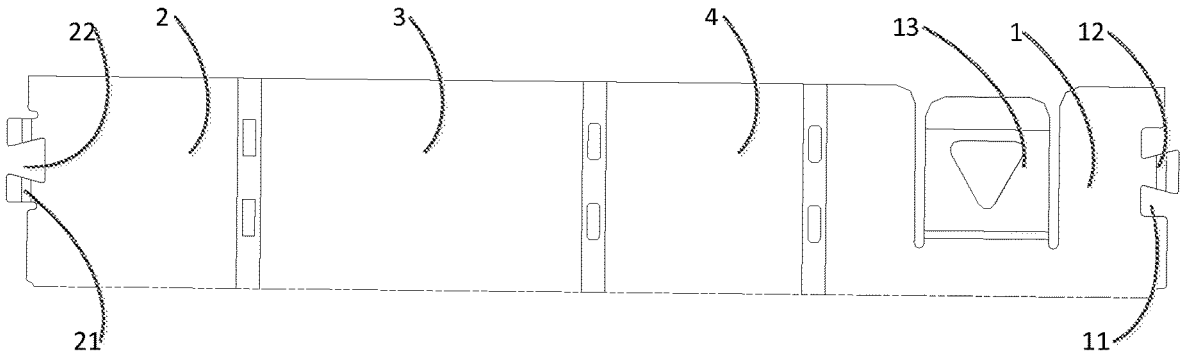
FIG. 10 is a plan view of the connector housing as a flat sheet prior to bending.

In an exemplary embodiment of the disclosure, referring to FIGS. 2 and 10, during manufacturing the connector housing 100, a metal sheet made of a single stainless steel, copper or alloy is punched, bent and cut to form the connector housing 100. Firstly, the first wall 1, the second wall 2, the third wall 3, the fourth wall 4, and the retaining elastic sheet 13 are formed by punching or cutting the metal sheet. Then the first positioning tooth 21 of the second wall 2 is bent vertically, and the metal sheet is bent to form a substantially rectangular parallelepiped profile. Thereafter, the bent first positioning tooth 21 is pressed into the corresponding first positioning grooves 11 from inside of the first wall 1. Then, the second positioning tooth 12 is bent vertically to enter the corresponding second positioning groove 22 of the second wall 2 from outside of the second wall 2 so as to realize the connection between the first wall 1 and the second wall 2. In this way, it is possible to realize the connection of the first wall 1 and the second wall 2, thereby preventing a tiny gap from being generated at the corner where the first wall and the second wall are connected with each other.

In another manufacturing process, the first wall 1, the second wall 2, the third wall 3 and the fourth wall 4, and the retaining elastic sheet 13 are formed by punching or cutting the metal sheet. Then the second positioning tooth 12 of the first wall 1 is bent vertically, and the metal sheet is bent to form a substantially rectangular parallelepiped profile. Thereafter, the bent second positioning tooth 12 is pressed into the corresponding second positioning groove 22 from inside of the second wall 2. Then, the second positioning tooth 12 are bent vertically to enter the corresponding first positioning groove 11 of the first wall 1 from outside of the first wall 1. In this way, it is possible to realize the connection of the first wall 1 and the second wall 2, thereby preventing a tiny gap from being generated at the corner where the first wall and the second wall are connected with each other.

Figure 9:
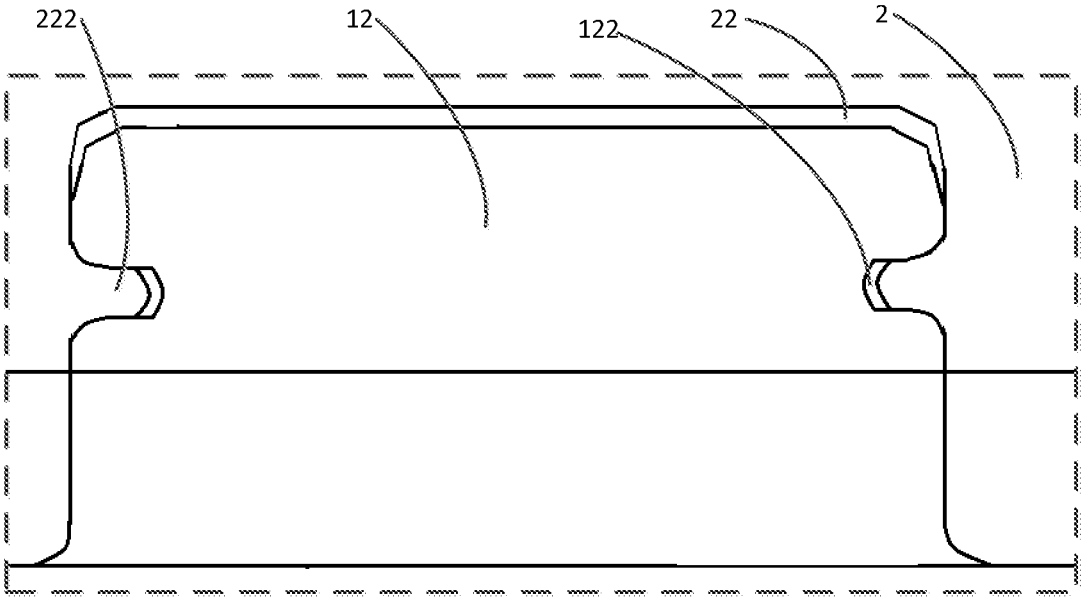
FIG. 9 is a schematic enlarged view of the part B according to another embodiment.

Referring to FIG. 9, in an alternative embodiment of the disclosure, the second locking feature may include a second protrusion 222 and a second recess 122. The second protrusion 222 is formed on the second positioning groove 22 and protrudes in the length direction of the connector housing 100 (the left-and-right direction in FIG. 9). The second recess 122 is formed in the second positioning tooth 12 and is configured to receive the second protrusion 222. Since the length direction is perpendicular to the lateral direction, it is possible to prevent the first wall 1 from moving outwardly (downwardly) in the height direction.

Figure 11:
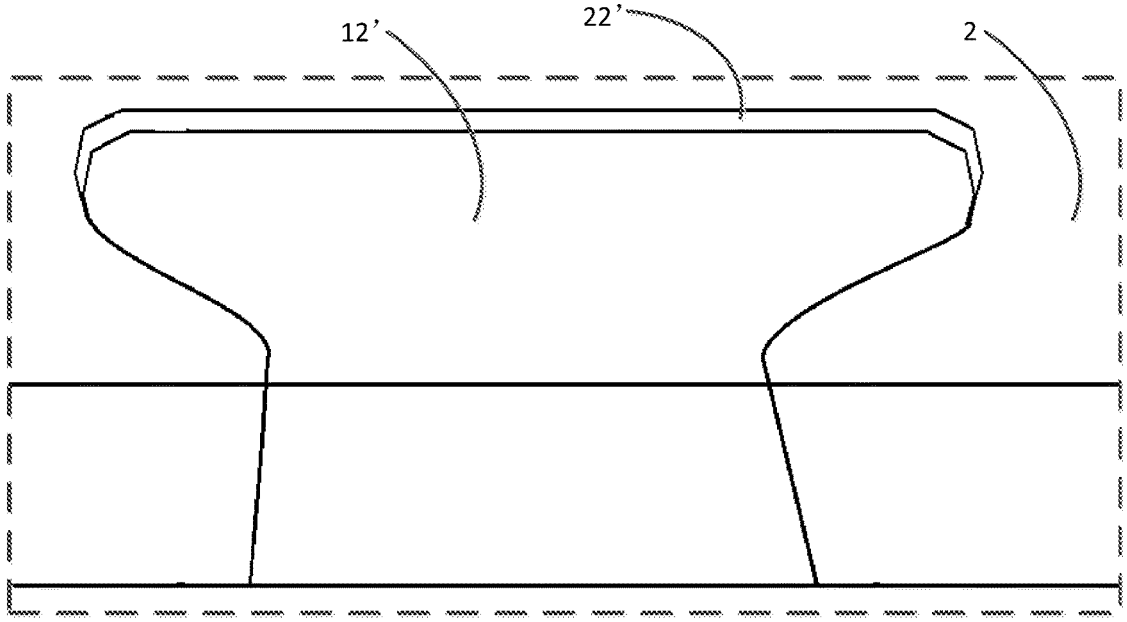
FIG. 11 is a schematic enlarged view of the part B according to another embodiment.

In an exemplary embodiment of the disclosure, as shown in FIG. 11, the second positioning groove 22' is formed as a dovetail groove, and the second positioning tooth 12' is formed as a dovetail tooth. Similarly, the first positioning groove 11 is formed as a dovetail groove, and the first positioning tooth 21 is formed as a dovetail tooth. In this way, the adjacent sides of the first wall 1 and the second wall 2 may be closely and firmly connected to each other by the dovetail teeth and the dovetail grooves.

In an exemplary embodiment of the disclosure, as shown in FIGS. 2, 5 and 10, the connector housing 100 has two first positioning grooves 11 and two first positioning teeth 21. The second positioning tooth 12 extends from the first wall 1 between the two first positioning grooves 11, and is vertically bent and then fit into the second positioning grooves 22. At the same time, the two first positioning teeth 21 extend from the second wall 2 and are vertically bent and then fit into the first positioning grooves 11. In this way, the first positioning grooves 11 and the second positioning tooth 12 are alternately arranged on the first wall 1, and the second positioning groove 22 and the first positioning tooth 21 are alternately arranged on the second wall 2.

Figure 3:
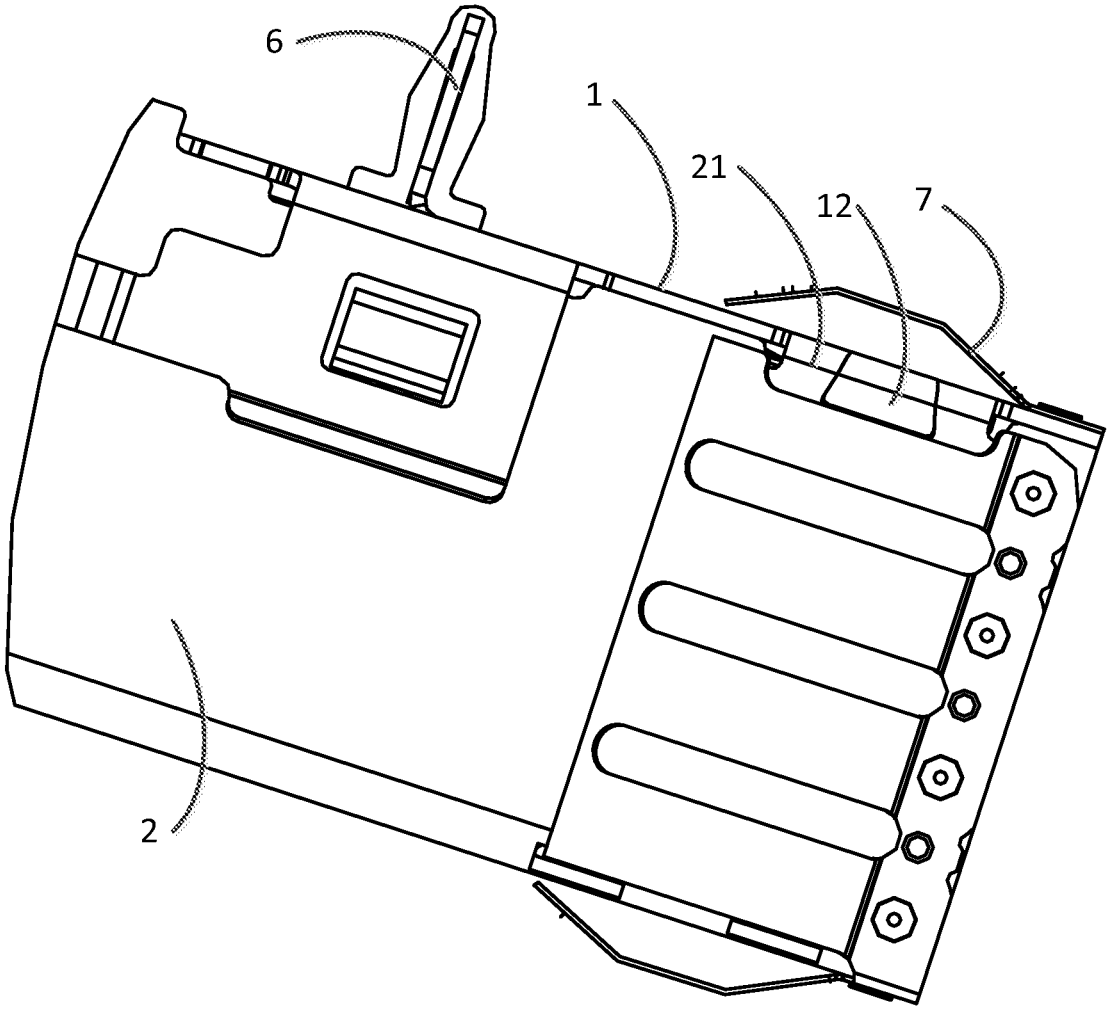
FIG. 3 is a detail side view of a portion of the connector housing of FIG. 1.

In an exemplary embodiment of the disclosure, as shown in FIGS. 1 to 3, the connector housing 100 further comprise an electromagnetic shielding elastic sheet 7 mounted on the four walls proximate to the insertion port 5. In the shown embodiment, the electromagnetic shielding elastic sheet 7 is riveted on the four walls proximate to the insertion port 5 by riveting elements 71.

In the embodiments as described above, an embodiment in which the first and second wall 1, 2 of the connector housing 100 are closely and firmly connected with each other is described taken the bottom wall and the side wall as an example. However, the disclosure is not limited to the above embodiment. For example, the first wall 1 and the second wall 2 may be a top wall and a side wall, respectively. The locking feature as described above may have other shapes and/or sizes as long as they may closely and firmly connect the two adjacent walls 1, 2 of the connector housing 100 together.

According to the connector housing 100 of the embodiments of the disclosure, the first wall 1 acted as the bottom wall and the second wall 2 acted as the side wall are provided with the second positioning tooth 12 and the first positioning tooth 21 which are bidirectionally bent, for example, the two-way dovetail tooth or the two-way wedge-shaped tooth, so that the side wall may be prevented from moving in the lateral direction by the first positioning tooth 21 provided on the bottom wall, and the bottom wall may be prevented from moving up and down. Since such positioning tooth 12, 21 and positioning groove 11, 22 are spaced apart from the insertion port 5 only by a minimum distance of less than 2 mm, a sufficient holding force may be provided. For example, the holding force of a single insertion port 5 actually measured is greater than 10 kg, which is better than 8 kg standard required for the connector housing 100 design. When a male plug of the optical module is inserted into the connector housing 100, there will be no obvious gap in the area proximate to the insertion port 5, thus ensuring that the connector housing 100 has excellent electromagnetic shielding performance, and the appearance of the connector housing 100 may also meet customer needs.

Further, the connector housing 100 according to the embodiments of the disclosure has a compact structure, and may provide a greater holding force proximate to the insertion port 5 than a solder joint, and the product structure is more stable. The connector housing 100 may be applied to a full series of connectors from a single-layer and single insertion port 5 to a double-layer and multiple insertion ports 5. The bi-directionally bent second positioning tooth 12 and first positioning tooth 21, and the matching second positioning groove 22 and first positioning groove 11 thereof may be manufactured through punching and bending processes, and may realize an automatic in-mold assembly together with the electromagnetic shielding elastic sheet to realize integrated design and fully automated manufacturing process of the connector housing 100. In addition, the engagement of the positioning tooth 12, 21 and the positioning grooves 11, 22 may omit a welding process, thereby improve production efficiency and reducing manufacturing cost.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate the preferred embodiments of the disclosure by way of example, and should not be construed as limitation to the disclosure.

Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the disclosure.

What is claimed is:

1. A connector housing, comprising:

an accommodation space defined by four walls and formed with an insertion port, the four walls include a first wall extending in a first plane and a second wall extending in a second plane perpendicular to the first plane, the first wall is connected with the second wall at a corner of the connector housing;

a first positioning groove disposed in an edge of the first wall proximate to the insertion port;

a first positioning tooth disposed on an edge of the second wall, the first positioning tooth extending in the first plane by vertically bending and engaging within the first positioning groove, the first positioning tooth and the first positioning groove have a first locking feature preventing the first positioning tooth from being disengaged from the first positioning groove in a direction perpendicular to the second plane;

a second positioning groove disposed in the edge of the second wall proximate to the insertion port; and a second positioning tooth disposed on the edge of the first wall and extending in the second plane by vertically bending and engaging within the second positioning groove.

2. The connector housing of claim 1, wherein the first locking feature includes a first protrusion formed on one of the first positioning tooth and the first positioning groove and protruding in a length direction of the connector housing.

3. The connector housing of claim 2, wherein the first locking feature includes a first recess formed in the other of the first positioning tooth and the first positioning groove and receiving the first protrusion.

4. The connector housing of claim 3, wherein the first positioning groove is formed as a wedge-shaped groove and the first positioning tooth is formed as a wedge-shaped tooth.

5. The connector housing of claim 3, wherein the first positioning groove is formed as a dovetail groove and the first positioning tooth is formed as a dovetail tooth.

6. The connector housing of claim 1, wherein the second positioning tooth and the second positioning groove have a second locking feature preventing the second positioning tooth from being disengaged from the second positioning groove in a direction perpendicular to the first plane.

7. The connector housing of claim 6, wherein the second locking feature includes a second protrusion formed on one of the second positioning tooth and the second positioning groove and protruding in a length direction of the connector housing.

8. The connector housing of claim 7, wherein the second locking feature includes a second recess formed in the other of the second positioning tooth and the second positioning groove and receiving the second protrusion.

9. The connector housing of claim 8, wherein the second positioning groove is formed as a wedge-shaped groove and the second positioning tooth is formed as a wedge-shaped tooth.

10. The connector housing of claim 8, wherein the second positioning groove is formed as a dovetail groove and the second positioning tooth is formed as a dovetail tooth.

11. The connector housing of claim 1, further comprising an electromagnetic shielding elastic sheet mounted on the four walls proximate to the insertion port.

12. A connector housing, comprising:

an accommodation space defined by four walls and formed with an insertion port, the four walls include a first wall extending in a first plane and a second wall extending in a second plane perpendicular to the first plane, the first wall is connected with the second wall at a corner of the connector housing;

a first positioning groove disposed in an edge of the first wall proximate to the insertion port;

a first positioning tooth disposed on an edge of the second wall, the first positioning tooth extending in the first plane by vertically bending and engaging within the first positioning groove, the first positioning tooth and the first positioning groove have a first locking feature preventing the first positioning tooth from being disengaged from the first positioning groove in a direction perpendicular to the second plane; and an electromagnetic shielding elastic sheet mounted on the four walls proximate to the insertion port, the electromagnetic shielding elastic sheet is riveted on the four walls proximate to the insertion port by a plurality of riveting elements.

13. A connector housing, comprising:

an accommodation space defined by four walls and formed with an insertion port, the four walls include a first wall extending in a first plane and a second wall extending in a second plane perpendicular to the first plane, the first wall is connected with the second wall at a corner of the connector housing;

an electromagnetic shielding elastic sheet mounted on the walls proximate to the insertion port, a first end of the elastic sheet mounted to the walls adjacent the insertion port and having a second end opposite the first and extending in a length direction of the connector housing away from the insertion port so as to overlap end portions of the four walls;

a first positioning groove disposed in an edge of the first wall proximate to the insertion port and within the overlapped end portion of first wall;

a first positioning tooth disposed on an edge of the second wall, the first positioning tooth extending in the first plane by vertically bending and engaging within the first positioning groove, the first positioning tooth and the first positioning groove have a first locking feature preventing the first positioning tooth from being disengaged from the first positioning groove in a direction perpendicular to the second plane.

14. The connector housing of claim 13, further comprising a second positioning groove disposed in the edge of the second wall proximate to the insertion port.

15. The connector housing of claim 14, further comprising a second positioning tooth disposed on the edge of the first wall.

16. The connector housing of claim 15, wherein the second positioning tooth extends in the second plane by vertically bending and engaging within the second positioning groove.

17. The connector housing of claim 16, further comprising a pair of first positioning grooves, the second positioning tooth extends from the first wall between the first positioning grooves.

18. The connector housing of claim 16, wherein any one of the first positioning groove, the first positioning tooth, the second positioning groove, and the second positioning tooth are spaced apart from an edge of the insertion port by a minimum distance of less than 2 mm.

19. The connector housing of claim 13, wherein the first locking feature comprises:

an elongated protrusion extending from one of the first positioning tooth or the first positioning groove in the length direction of the connector housing; and an elongated recess formed into the other one of the first positioning tooth or the first positioning groove in the length direction of the connector housing and receiving the elongated protrusion.

20. The connector housing of claim 19, wherein the elongated protrusion and the elongated recess extend linearly in the length direction of the connector housing.

* * * * *